United States Patent [19]

Paxon

[11] Patent Number: 4,787,106

[45] Date of Patent: Nov. 29, 1988

[54] BODY SUPPORT DEVICE SUCH AS CUSHIONS OR PILLOWS

[76] Inventor: John B. Paxon, 123, Abbey Foregate, Shrewsbury SY2 6A2, United Kingdom

[21] Appl. No.: 925,635

[22] PCT Filed: Aug. 23, 1985

[86] PCT No.: PCT/GB85/00380

§ 371 Date: Jun. 13, 1986

§ 102(e) Date: Jun. 13, 1986

[87] PCT Pub. No.: WO86/01385

PCT Pub. Date: Mar. 13, 1986

[30] Foreign Application Priority Data

Aug. 23, 1984 [GB] United Kingdom ..... 8421408

[51] Int. Cl.[4] ..... A47C 7/42; A47C 7/46; A47C 27/20

[52] U.S. Cl. ..... 5/432; 5/439; 5/447; 297/460

[58] Field of Search ..... 5/447, 446, 432, 433, 5/439, 462; 297/460

[56] References Cited

U.S. PATENT DOCUMENTS

| | | | |
|---|---|---|---|
| 588,957 | 8/1897 | Cowley | 5/439 |
| 1,222,175 | 4/1917 | Bobrick | 5/439 |
| 2,291,806 | 8/1942 | Diehl | 5/439 |
| 3,241,879 | 3/1966 | Castello et al. | 297/466 |
| 3,459,611 | 8/1969 | Joseph | 156/78 |
| 3,974,827 | 8/1976 | Bodeen | 128/70 |
| 4,601,514 | 7/1986 | Meiller | 297/460 |

FOREIGN PATENT DOCUMENTS

| | | | |
|---|---|---|---|
| 1063043 | 8/1959 | Fed. Rep. of Germany | 297/460 |
| 1654168 | 3/1971 | Fed. Rep. of Germany . | |
| 1110462 | 5/1960 | France . | |
| 2457665 | 12/1980 | France . | |
| 2527526 | 12/1983 | France | 297/460 |
| 465198 | 12/1968 | Switzerland . | |
| 315456 | 7/1929 | United Kingdom . | |
| 330455 | 6/1930 | United Kingdom . | |
| 1243461 | 8/1971 | United Kingdom . | |
| 1320891 | 6/1973 | United Kingdom . | |
| 2082056 | 3/1982 | United Kingdom . | |

*Primary Examiner*—Alexander Grosz

[57] ABSTRACT

A convex body support pad (2) mounted inside a rigid frame (5) by resilient means (6) and placed inside a case containing filling to form a portable cushion. The convex support pad may be a solid lump or may be hollow and may contain a vibrator. The resilient fixings may be attached at their one end to the convex pad and at their other end to the frame or the resilient fixings may be fixed to a plate on to which the convex support pad is fixed or of which it is a part. The convex support pad may be resting on springs or other resilient materials stretched across the frame to give localized support and/or vibratory treatment to the user, or fixed to the springs as aforesaid.

7 Claims, 2 Drawing Sheets

BODY SUPPORT DEVICE SUCH AS CUSHIONS OR PILLOWS

This invention relates to body support devices of the kind comprising a case containing a filling, such as a cushion or pillow. Such a device will hereinafter be referred to as a 'portable cushion'.

The invention is concerned with providing correct support to the body of a user.

Proposals have been made involving the use of springs across the whole plan area of the inside of cushions. These are expensive to produce and can give no proper support to a localised area of the body, for example the lumbar regions of the spine. Those cushions without springs tend to provide poor general overall support, no localised support, or are too hard and firm over the whole area.

The aim of the present invention is to provide a simple and cheap form of resilient support structure for incorporation into a portable cushion, the support structure providing increased localised support to the body.

According to the invention a portable cushion comprises a support structure mounted at least substantially within the interior of the case, the support structure comprising a substantially rigid frame, and a local support pad mounted within the interior of the frame by resilient connection means between the support pad and the frame.

The resilient connection means might possibly be a single sheet of resilient material, but preferably the resilient connection means comprises a plurality of spaced resilient connections.

The support pad may simply be a convex rigid plate, but it could be formed of a semi-rigid material, as a bulbous plastics member for example. Alternatively the pad may be of a composite construction, such as a rigid flat plate provided on one side, the outer side in use, with suitable conventional padding material of appropriate thickness, shape and type. The padding material for the plate may itself be moulded.

It will be appreciated that the form of the support pad, its shape, rigidity, resilience and size may readily be chosen or adapted in manufacture to suit the needs of the particular user.

The resilient connections preferably lie substantially within the plane of the frame.

The resilient connections each preferably comprises a coiled tension spring of which one end is attached to the support pad, and the other end is attached to the frame, but the resilient connections may be in the form of elasticated belts or cords.

The elasticity and pre-tension of the resilient connnections may be chosen to suit the user.

The frame is preferably in the form of a closed hoop which may be of any convenient shape, but an open-ended frame, such as a U-shaped frame, might be employed.

The frame preferably comprises a single member which surrounds the support pad, such as a tube or flat strip of metal with its ends rigidly secured together. Alternatively, the frame may be produced from plastics or some other rigid material.

The frame will help to prevent the cushion or pillow etc. from collapsing in use, and the support pad will provide local, resilient support for a part of the user's body.

The support structure is preferably embedded to a greater or lesser degree within the filling of the body support device. It is preferred in particular that the frame when viewed in plan is surrounded by filling material, so that the frame does not provide a hard edge to the body support device. However, if in a particular circumstance it is desired to have the frame extend to the edge of the portable cushion, then this would be possible.

The filling material may be of any of the usual types employed in cushions etc. When a foamed resilient filling is employed then the support structure may be mounted in a shallow recess cut into a slab of the foam, the recess then being covered by a sheet of the foam, which may be in the form of an integral flap on the foam block.

Alternatively, it might be possible to mould the foam block in situ around the support structure, so that the structure is more or less encased by the foam material.

The case of the portable cushion, may be a stitched case, or it may be provided with a releasable fastening, such as a zipper closure, which enables the filling to be removed and reinserted into the case.

The case may be provided with a carrying handle, or a handle might be attached to the frame if desired, or a part of the frame could project from the case to provide a handle.

In my U.K. Patent Specification No. 1 320 891 I have claimed a vibrator for use on beds or chairs comprising a casing containing an electric motor driving a rotary unbalanced mass, the casing being provided with resilient means adapted for anchoring it to the springs of a bed or to upholstery of a chair and the motor being connected to a timer unit for putting the vibrator into action for a timed period.

The support structure of the present invention may readily be adapted to incorporate such a vibrator, said casing constituting or forming part of said support pad, such that on operation of the motor the support pad is vibrated. Thus, the support pad would then provide local resilient support for a particular part of the user's body, and in addition would provide a therapeutic vibratory action on that part.

A support structure, and a cushion incorporating the support structure, all in accordance with the invention, will now be described by way of example only, with reference to the accompanying schematic drawings in which.

Figure 1:
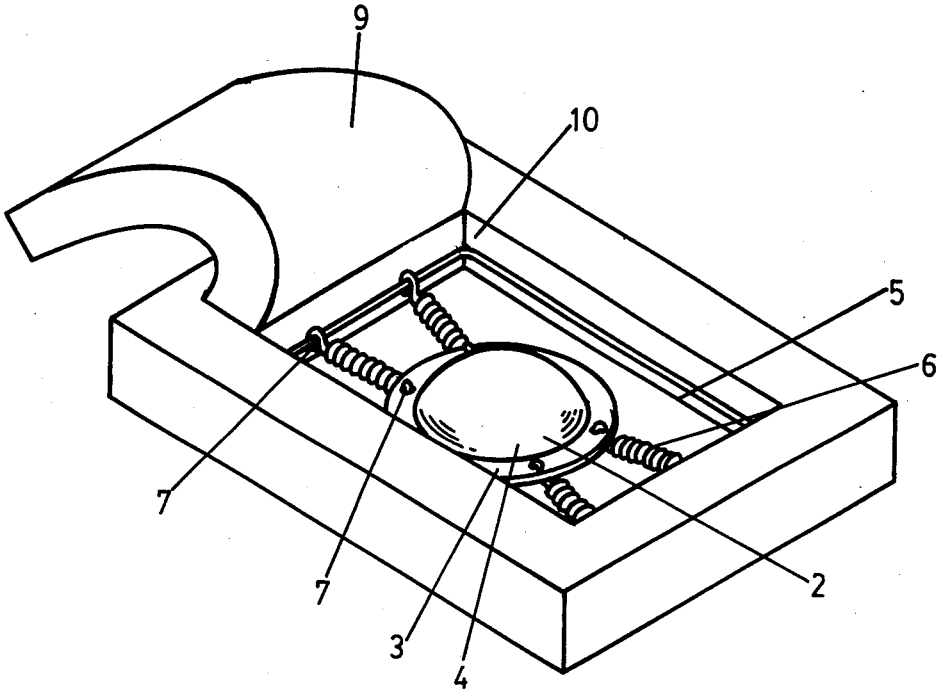
FIG. 1 is a perspective view of a hollow foam pad filling for the cushion, and showing the support structure mounted within the interior of the pad.
Figure 2:
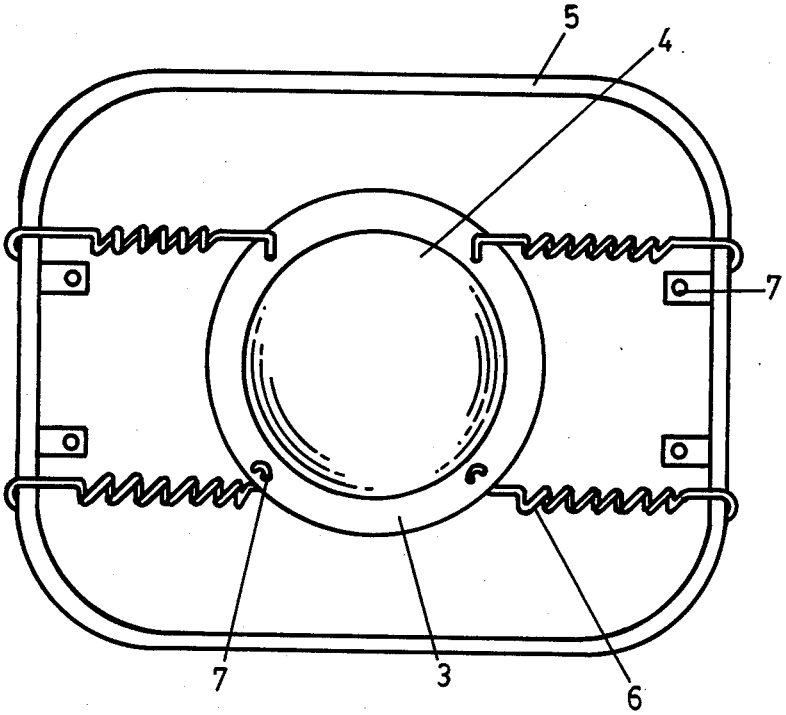
FIG. 2 is a plan view of the support structure of FIG. 1.

With reference to FIGS. 1 and 2 the support structure 1 comprises a pad 2 comprising an oval flat metal plate 3 to which is bonded a dome-shaped pad member 4, formed of plastics for example.

The plate 3 is surrounded by a metal frame 5 constructed as a closed rectangular hoop from a length of metal tube or flat metal strip for example, the ends of the length being rigidly secured together. Four spaced-apart pre-tensioned tension springs 6 are connected between the plate 3 and the frame 5, the springs normally lying substantially within the plane of the frame 5, in the absence of body weight. The springs 6 have hooked opposite ends which are respectively located in holes 7 provided in the periphery of plate 3 or in tags secured to the plate, and in holes 7' provided directly in the frame 5 or in tags secured to the frame, or the outer ends may be simply hooked over the frame.

As shown in FIG. 1, the support structure may conveniently be mounted within a cushion filling in the form of a foam block 8 which has been sliced to define a depending flap portion 9 and has been provided with a shallow recess 10 of complementary shape in plan to that of frame 5 to recieve snugly the frame 5. This arrangement of cushion filling ensures that the frame is surrounded, as viewed in plan, by foam material, thereby avoiding a hard edge to the cushion.

It will be appreciated that the pad member 4 provides an area of local resilient support in the region of the centre of the cushion, as viewed in plan, which area of support is firmer than the support provided in adjacent areas of the cushion. Since the pad member 4 is resiliently supported it will adjust its position relative to frame 5 to suit the weight of the user.

Figure 3:
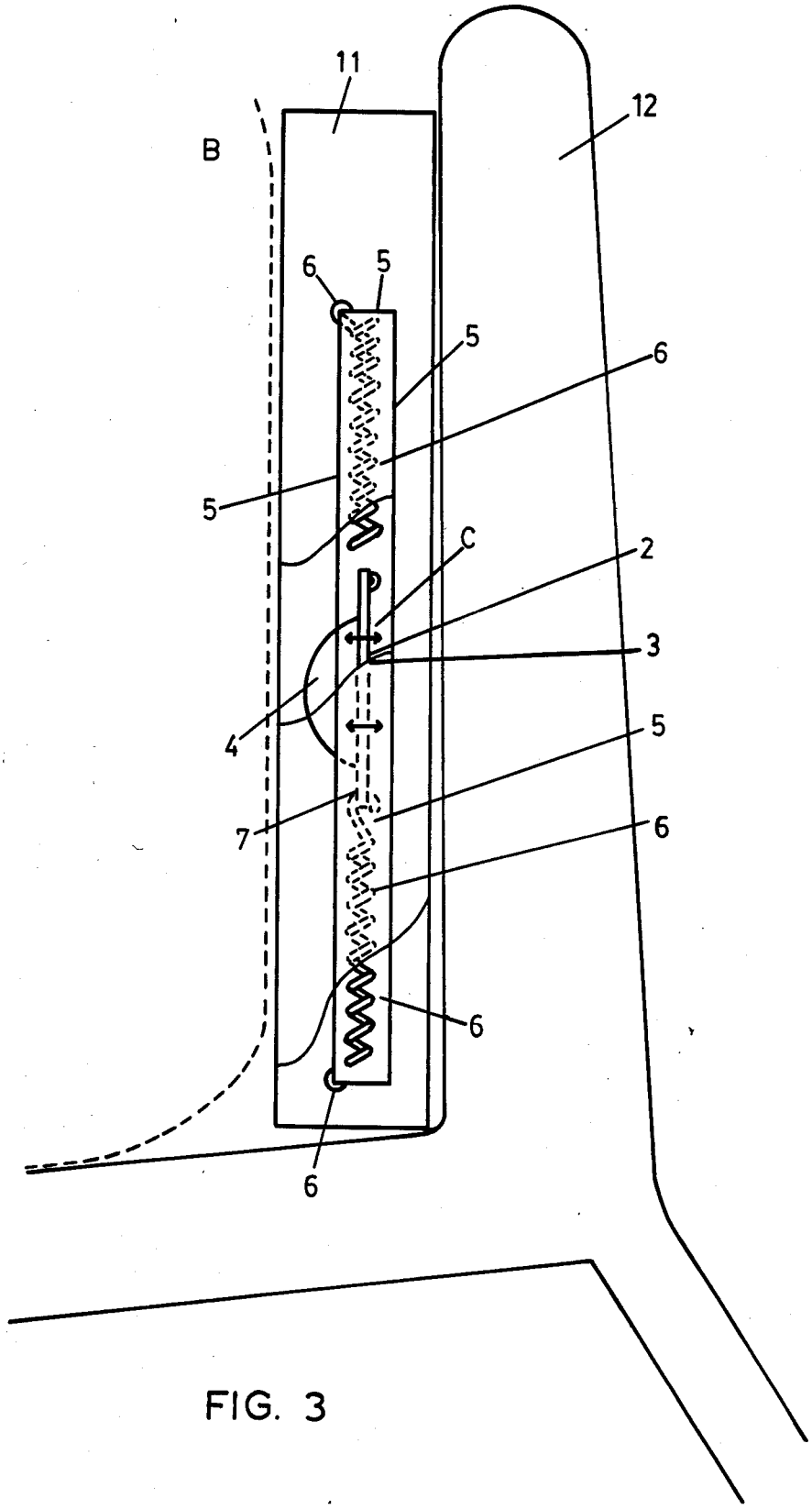
FIG. 3 is a vertical cross-section of a cushion incorporating the pad and support structure of FIG. 1, shown resting on an upholstered chair.

The block 8 is enclosed in this example in a snugly fitting plastics case 11, FIG. 3, which is provided along three sides with a continuous zipper closure enabling the block 8, with the support structure 1 contained in it, to be inserted into and removed from the case. This ease of assembly would enable the user to make alterations to the configuration of the pad member 4 as necessary to suit the user's condition, and enables the whole product to be quickly and easily assembled by the manufacturers.

The completed cushion is shown in use in FIG. 3 on an upholstered chair 12. The back of a user is indicated in dashed outline at B, and the manner in which the cushion deforms to accommodate users of different weights is indicated by arrows C.

In a modified construction the foam block 8 is replaced by two plain slabs of foam, or individual cushions, of polyester for example, and the support structure is simply sandwiched between the two slabs or cushions.

The case 11 may, of course, be constructed in a conventional manner, and if desired of a material to match the upholstered chair.

The cushion could be a fixed cushion of an upholstered chair or car seat.

I claim:

1. A portable cushion comprising a support structure mounted within a case, said support structure comprising, in combination, a rigid frame with a convex support pad fixed to the frame by resilient connection means, the support structure located in the interior portion of the cushion, and being surrounded by a solid, soft, filling or padding material.

2. A cushion as claimed in claim 1 in which the support pad is mounted on a plate fixed to the frame by resilient means.

3. A cushion as claimed in claim 1, in which the frame is in the form of a closed hoop.

4. A cushion as claimed in claim 1, in which the frame is open-ended or "U"-shaped.

5. A cushion as claimed in claim 1, in which a vibrator is incorporated into and forming part of the support pad to provide a vibratory action on that part of the body resting on or pressed against the cushion.

6. A cushion as claimed in claim 1, in which the resilient means comprises a flat sheet or belts of resilient material.

7. A cushion as claimed in claim 1, in which the case has a closeable opening permitting the removal of the support structure, and the insertion of the filling.

* * * * *